US005574237A

United States Patent [19]

Yanagisawa

[11] Patent Number: 5,574,237

[45] Date of Patent: Nov. 12, 1996

[54] BASS DRUM PEDAL ASSEMBLY WITH MOVEABLE HEEL PLATE

[75] Inventor: Mitsuo Yanagisawa, Chiba, Japan

[73] Assignee: Pearl Musical Instrument Co., Chiba, Japan

[21] Appl. No.: 534,579

[22] Filed: Sep. 27, 1995

[51] Int. Cl.[6] ..... G10D 13/02

[52] U.S. Cl. ..... 84/422.1

[58] Field of Search ..... 84/422.1, 422.2, 84/422.3

[56] References Cited

U.S. PATENT DOCUMENTS

| | | | |
|---|---|---|---|
| 2,672,784 | 3/1954 | Sabo | 84/422.1 |
| 2,893,284 | 6/1956 | Washington, Jr. | 84/422.1 |
| 4,346,638 | 8/1982 | Hoshino | 84/422.1 |
| 4,691,613 | 8/1987 | Jacobson | 84/422.1 |
| 5,185,489 | 2/1993 | Hoshino | 84/422.1 |
| 5,458,038 | 10/1995 | Kurosaki | 84/422.1 |

*Primary Examiner*—Patrick J. Stanzione
*Attorney, Agent, or Firm*—Longacre & White

[57] ABSTRACT

An improved foot pedal features a moveable heel piece and footboard with fore and aft motion along the pedal's base plate. By sliding the heel piece and footboard, the position of the top of the footboard can be changed in relation to the position of the pedal's wheel section, in turn changing the pulling direction of the chain which links the top of the footboard with the wheel section. By altering the pulling direction of the chain, the feel and action of the pedal is made relatively lighter or heavier allowing the drummer to customize the performance characteristics of the pedal beyond the typical range of the pedal adjustments.

20 Claims, 4 Drawing Sheets

BASS DRUM PEDAL ASSEMBLY WITH MOVEABLE HEEL PLATE

BACK OF THE INVENTION

1. Field of the Invention

The present invention relates to a foot operated pedal assembly for a bass drum, and more particularly to an adjustable heel piece which allows the drummer to customize the performance characteristics of the pedal.

2. Description of the Prior Art

Numerous patents relate to the subject of bass drum pedal assemblies. Many drum pedal assemblies use a variety of methods for driving the hammer against a drum. Several of these pedals use a collar mounted on a rotating shaft to cause a hammer shaft and hammer to rotate upon rotation of the rotating shaft. Also attached to the rotating shaft is a cam or sprocket driven by a chain attached to a footboard. When the footboard is depressed the tension in the chain causes the cam, shaft, collar, and thus the hammer shaft and hammer, to rotate until the hammer strikes the membrane of a drum. A coiled return spring is attached to the rotating shaft to bias the shaft such that the hammer is held a predetermined distance away from the drum's membrane. U.S. Pat. No. 4,346,638 discloses such a conventional arrangement and is incorporated herein by reference. However, few bass drum pedals disclose a simple means to adjust the performance characteristics of the driven hammer with respect to the movement of the footboard.

U.S. Pat. No. 4,691,613 discloses such a conventional drum pedal arrangement with various adjustment means and is incorporated herein by reference. The amount of rotation of the shaft in relation to a given depression of the footboard is changed by adjusting the relative position of an eccentric cam with respect to the rotating shaft. The angle of the footboard, in the held position, is adjusted by increasing or decreasing the length of the chain. Because the footboard may be adjusted to several angles, the heel portion of the footboard needs support in a variety of positions. Therefore, an extendable support member is provided which extends from the drum pedal's supporting frame. The extending member, does not however, provide adjustment of the performance characteristics of the drum pedal.

The problem with the prior art drum foot pedal assemblies is that they either provide no adjustment mechanisms at all or several adjustments are required to achieve the desired performance characteristics personal to a particular drummer. Additionally, the prior art does not provide a simple means to change the relative position of the top of the footboard with respect to the pedal's sprocket or cam. Furthermore, no prior art discloses the adjustment of the performance characteristics of the drum pedal by simply sliding the heel plate horizontally fore and aft with respect to a supporting base plate.

SUMMARY OF THE INVENTION

The primary object of this invention is to provide a foot operated bass drum pedal with a simple means to adjust the performance characteristics of the pedal.

The foot operated pedal comprises two upstanding support members separated by a cross member deposed between the lower portions of said support members. The two upstanding support members in turn hold a rotating shaft deposed between their upper portions. A collar is mounted on the rotating shaft which in turns supports a hammer shaft and hammer such that rotation of the rotating shaft causes the hammer shaft and hammer to rotate towards the membrane of the drum. A wheel or sprocket is mounted on the rotating shaft and is driven by a chain which is also attached to the top of a footboard. A return spring is connected between a link member and an adjustment screw mounted to the base of one of the upstanding support members. The link member is in turn connected to a projection of the rotating shaft. The spring biases the rotating shaft such that the hammer is held a predetermined distance from the drum's membrane. The foot board comprises a heel plate hinged thereto supported by a base plate. The base plate extends the entire length of the pedal assembly from the heel piece past the front of the upstanding support members. The forward portion of the base plate Supports a clamp for attaching the pedal assembly to a drum. The rear portion of the base plate supports the heel plate and is provided with a simple means to adjust the heel piece horizontally fore and aft with respect to the base plate. When the heel piece is moved horizontally fore or aft the performance characteristics are altered.

The heel piece comprises a mechanism to selectively and securely engage various horizontal positions in relation to the rear portion of the base plate. By placing the heel piece in different positions on the rear portion of the base plate, the heel piece, and correspondingly the footboard, are shifted horizontally fore and aft. This causes the relative position between the top of the footboard and the sprocket to change and consequently alter the pulling direction of the chain and allow customization of the performance characteristics of the pedal.

Other and further objects, features and advantages of the invention will appear more fully from the following description.

DESCRIPTION OF THE PREFERRED EMBODIMENT

Figure 1:
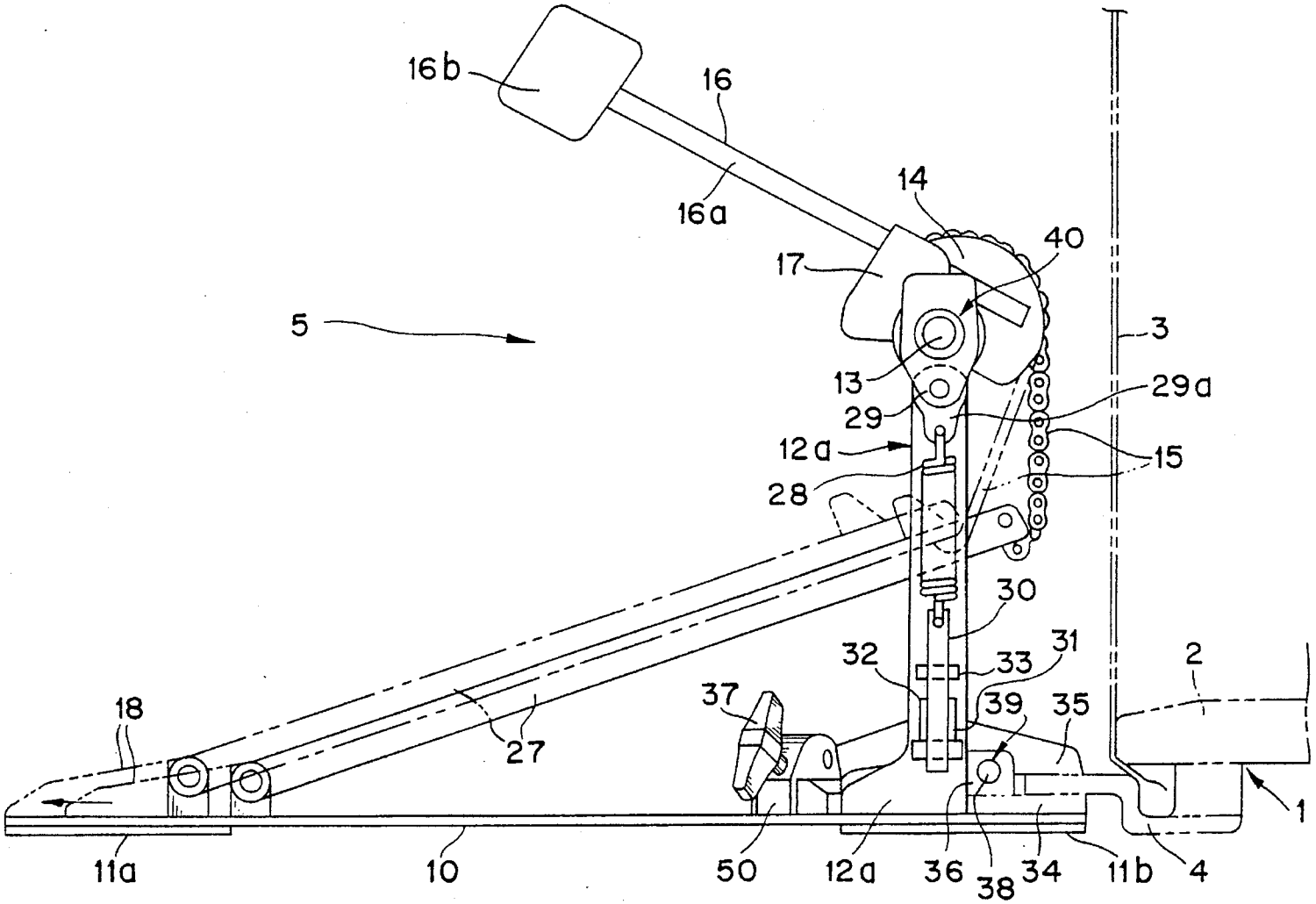
FIG. 1 is an elevated side view of the invention mounted to a bass drum.
Figure 2:
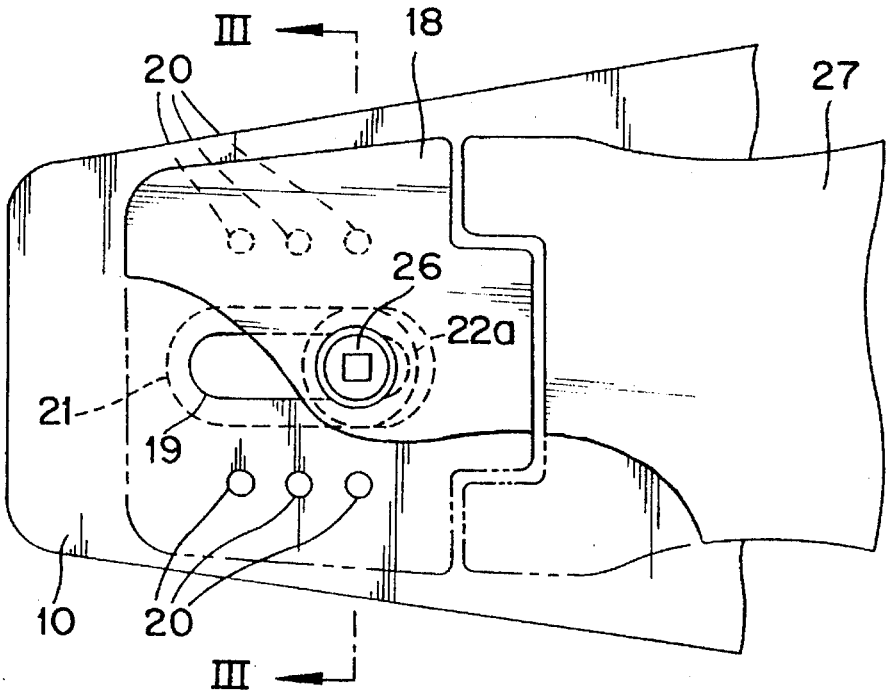
FIG. 2 is an enlarged top view of the heel piece and base plate assembly with a fragmentary portion exposing the slot and bores of the rear portion of the base plate.

Referring now to the drawings, the bass drum pedal arrangement is depicted generally at 5 in FIG. 1. The pedal comprises right and left upstanding support members 12 (left support member not shown, which lies deeper in FIG. 1 positioned correspondingly to the right support member as shown). The support members are separated by a cross member (not shown) deposed between the lower portions of the upstanding support members 12. The two support members 12 each have an aperture coaxially aligned at their upper ends to support a rotating shaft 13 deposed there between. The rotating shaft 13 extends beyond the right upstanding support member 12 to support a return lever 29. In the preferred embodiment a cylindrical sleeve 40 is fixedly mounted about shaft 13, where the shaft 13 extends from the right upstanding support member 12. The return lever 29 is then in turn mounted about the cylindrical sleeve 40.

Mounted on the rotating shaft 13, between the support members 12 are a collar 17 and a wheel 14. Wheel 14 is driven by a chain 15 such that when tension is applied to the chain the wheel and consequently the rotating shaft rotate. The collar 17 supports a hammer shaft 16*a* and a hammer 6*b* such that rotation of the shaft 13 causes the hammer shaft 16*a* and hammer 16*b* to move towards the drum's membrane 3. The collar 17 may be equipped with a means to secure the hammer-shaft 16*a* extending varying lengths from the collar 17.

A bracket 32 extends outwardly from the lower portion of the right support member 12 having an aperture to receive an adjustment bolt 30. A cinch nut 33 threadably engages the adjustment bolt 30 and is positioned above the bracket 32. An adjustment nut 31 threadably engages the adjustment bolt and is positioned just below the bracket 32. A link member 29*a* is rotatably mounted to the return lever 29 extending downwardly toward the adjustment bolt 30. A return coil spring 28 is attached to and interposed between the link member 29*a* and adjustment bolt 30.

The two support members 12, cross member and heel piece assembly 18 are mounted on top of a base plate 10. Base plate 10 extends forwardly towards the bass drum and is tapered rearward to the heel piece assembly 18. The base plate 10 is in turn mounted on top of two friction pads 11*a* and 11*b*. Friction pad 11*b* extending from the forward most portion of the base plate rearwardly past the upstanding support members and friction pad 11*a* extending from the rearward most portion of the base plate forward past the heel piece. These pads help prevent the pedal assembly from slipping on the floor during use.

A clamp member 34 is mounted on top of the base plate 10, forward and adjacent to the cross member, centrally deposed between the upstanding support members 12. In the preferred embodiment the clamp member 34 is integrally formed with support members 12 and the cross member. Right and left clamp hinge supports 36 (left clamp hinge support not shown, which lies deeper in FIG. 1 positioned correspondingly to the right clamp hinge support) are mounted on top of clamp member 34, spaced apart adjacent to the cross member 12. Each clamp hinge support 36 has a coaxially aligned aperture 39 to support a pintle 38. A clamp pivot arm 35 is deposed between clamp hinge supports 36 extending forwardly toward the bass drum and rearwardly toward the heel piece assembly 18. The pivot arm 35 has two integrally formed pintle members 38, extending outwardly to engage each of the apertures 39, such that rotation of the pivot arm 35 provides a clamping means between the forward portion of pivot arm 35 and the forward portion of clamp member 34. A clamp base 50 is mounted atop base plate 10 rearward of support members 12. A clamp screw 37 threadably engages the clamp base to engage the pivot arm 35 such that when screw 37 is tightened the pivot arm 35 rotates such that the distance between clamp member 34 and the forward end of pivot arm 35 is reduced enabling a pedal holder member 4 to be clamped therebetween. When the screw is loosened the pivot arm rotates so as to release pedal holder member 4.

Figure 3:
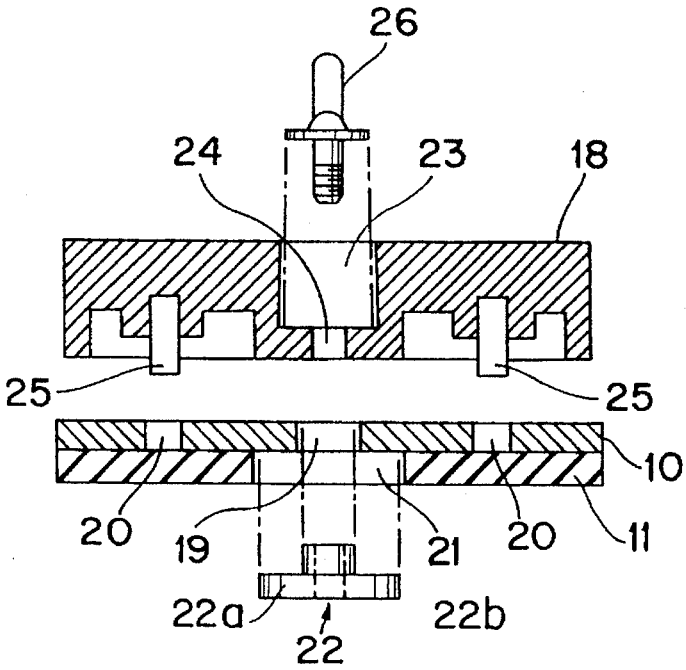
FIG. 3 is an enlarged exploded cross-sectional view of the heel-piece and base plate assembly taken along line III—III of FIG. 2.
Figure 4:
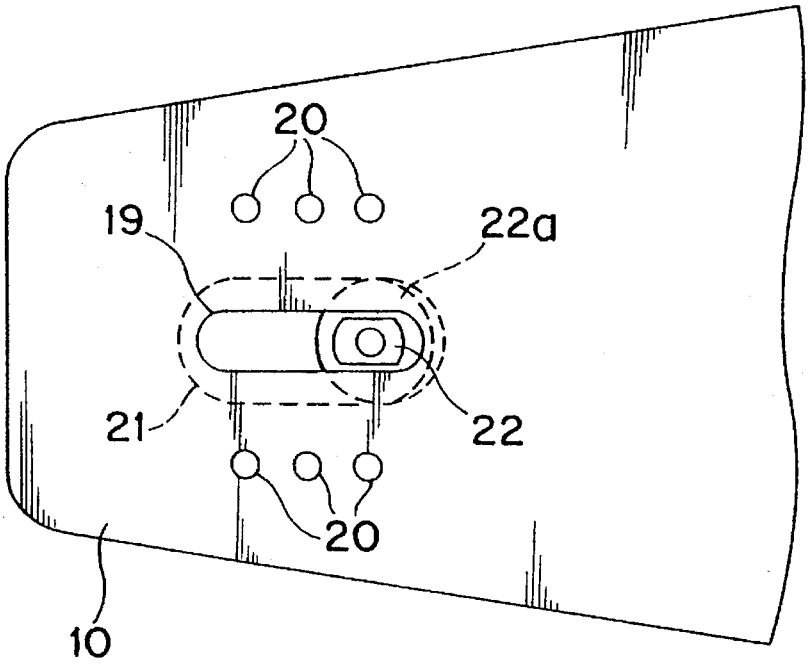
FIG. 4 is an elevated top view of the base plate and heel piece securing nut.
Figure 5:
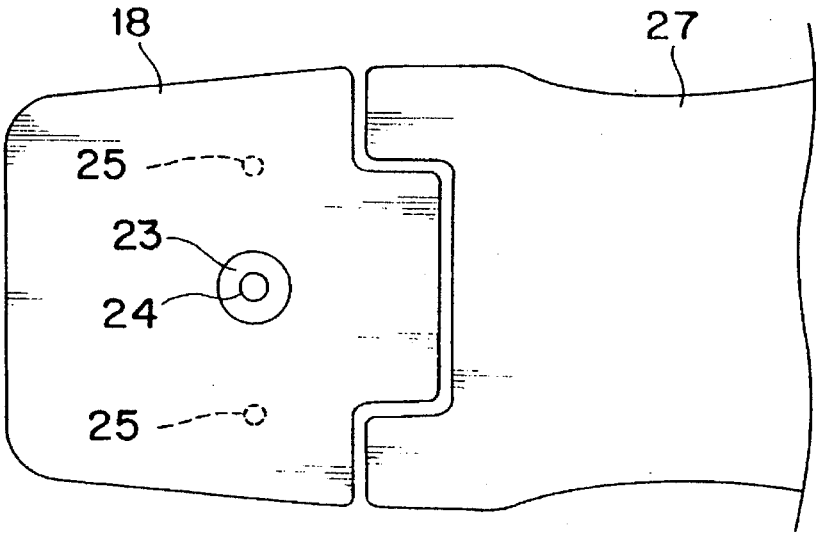
FIG. 5 is an elevated top view of the heel piece and heel piece securing bolt.

A footboard 27 is secured to the lower end of chain 15 at it's forward end and is hinged to heel piece 18 at it's rear end. FIG. 5 depicts the rear portion of footboard 27 and heel piece Referring to FIG. 3, the heel piece 18 has a bore extending therethrough generally at it's center. The upper diameter of the bore 23 is of a wider diameter to permit the widened part of securing bolt 26 to pass through. The lower diameter of the bore 24 is of a smaller diameter to permit the threaded portion of the securing bolt to extend through but to prohibit the widened portion of the bolt 26 from passing through the heel piece 18. This allows the top surface of heel piece 18 to remain flush when the securing bolt 26 is inserted. Equidistant from the lower bore 24 are right and left pegs 25 extending downwardly from the bottom surface of heel piece 18. Referring to FIG. 4, the rear portion of the base plate has a plurality of parallel bores 20 (three shown) correspondingly spaced apart to receive the exposed portion of pegs 25. A slot 19, parallel and centered between parallel bores 20, extends through base plate 10 for completely receiving the upper portion of a securing nut 22*b* but prohibiting the wider lower portion of the securing nut 22*a* from passing through. Friction pad 11*a* has a slot 21 co-aligned with and wider than slot 19. The width of slot 21 is sufficiently wide to receive the wider portion 22*a* so that the bottom surface of friction pad 11*a* remains flush with the floor. The securing nut 22 is able to slide for and aft in slots 19 and 21 but is prevented from rotating. Referring to FIG. 4, rotation of the securing nut 22 is prevented by the contact of flattened surfaces of the upper portion of the securing nut 22*b* against the inside surface of slot 19.

The operation and adjustment of the instant invention will now be described. When a drummer wishes to use the pedal assembly it is placed in front of the drum such that the length of the base plate 10 extends perpendicular from the surface of the drum's membrane 3 such that pedal holder member 4 is lodged between the forward portion of pivot arm 35 and clamp member 34. The clamp screw 37 is then tightened and the pedal assembly is firmly attached to the drum. The pedal assembly is then ready for adjustment.

Figure 6A:
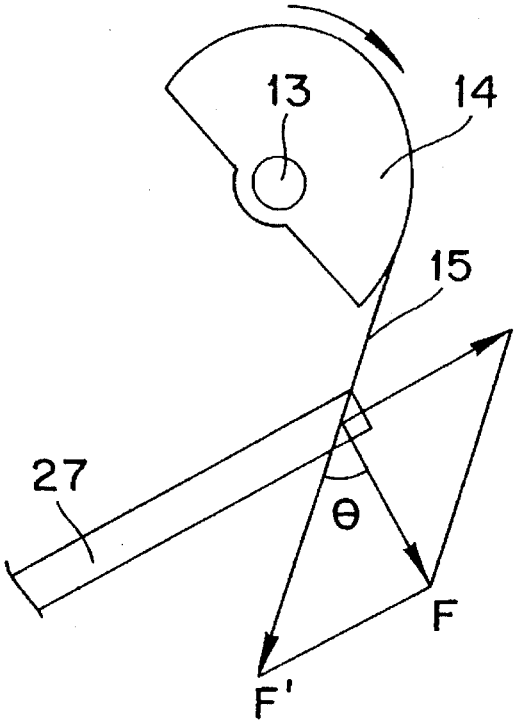
FIGS. 6A and 6B are schematic views illustrating two relative positions of the foot pedal, chain and wheel arrangement.
Figure 6B:
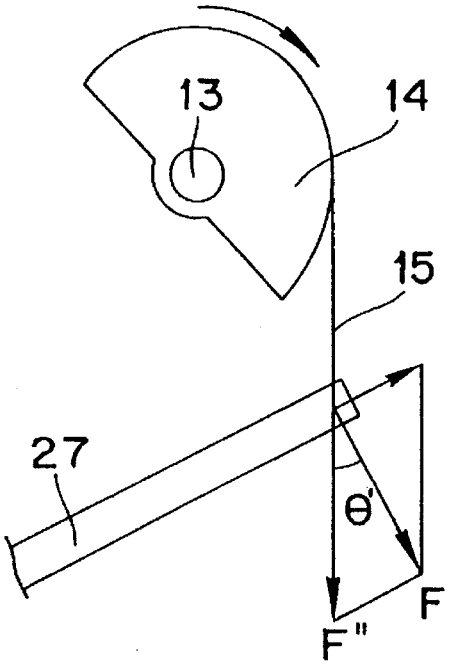

The adjustment of the performance characteristics of the drum pedal is simply achieved by sliding the heel piece 18 horizontally, either toward or away from the drum's membrane 3. This is achieved by loosening the securing bolt 26, lifting the heel piece 18 such that the pegs 25 are no longer within the bores 20 and sliding the heel piece to the desired position and allowing the pegs 25 to be inserted in another pair of corresponding bores 20. Securing bolt 26 is then tightened locking the heel plate 18 to the rear portion of the base plate 10. FIG. 6*a* is a schematic representation of the relative positions of the footboard 27, chain and wheel 14 when the heel piece is located more rearwardly. FIG. 6*b* represents a similar arrangement when the heel piece is in a more forward position. The tension in the chain when the foot board is depressed is represented by F'=F/cos theta. Because angle theta is smaller in a more forward position the tension F' is smaller than in a more rearward position. Hence, when the heel piece is moved forward the tension F' is decreased with respect to foot board depression resulting in a heavier feel. If a particular drummer desires a lighter action, the heel plate is simply moved rearward. This relative horizontal movement, between the heel plate 18 and a rigid one piece baseplate 10, gives a drummer a particularly desirous variation in the performance of the drum pedal assembly.

Adjustment to the return spring may be made by simply loosening cinch nut 33 and turning adjustment nut 31 to the desired tension and counter-turning the cinch nut 33 and the adjustment nut 31 to secure the setting. Increasing the tension of the return coil spring 28 will cause the hammer shaft 16*a* and hammer 16*b* to move away from the drum's membrane more quickly once pressure is eased from the foot board. A drummer who wishes a slower return response may simply lessen the tension in the return coil spring 28.

While the foot pedal assembly of this invention has been shown and described with reference to a particular embodiment, it will be understood to those possessing skill in the art that various changes to the form and detail may be made therein without departing from the spirit and scope of the invention.

I claim:

1. A foot operated bass drum assembly, comprising:

a means for striking a membrane of a drum to produce sound;

a base plate connected to said striking means and for supporting said assembly on an underlying surface, said base plate having a front and rear end;

a heel plate supported by said rear end of said base plate, wherein;

said heel plate is horizontally adjustable in relation to said rear end of said base plate.

2. A foot operated bass drum assembly as described in claim 1, wherein;

said striking means includes:

a footboard having front and rear ends, said rear end being hinged to said heel plate;

a pair of upstanding support members projecting from the front end of said base plate supporting a generally horizontally disposed rotating shaft therebetween;

a collar mounted to said rotating shaft for supporting a hammershaft and a hammer;

a wheel mounted on said rotating shaft for driving said rotating shaft;

a chain having a first and second end, the first end of which is attached to the front end of said foot board the second end being attached to said wheel.

3. A foot operated drum pedal assembly as described in claim 2, wherein;

said heel plate includes:

a bore extending therethrough generally located at it's center for receiving a securing bolt;

a pair of downwardly extending pegs equidistant from said bore;

said rear end of said base plate having:

a slot for receiving a securing nut allowing said securing nut to slide horizontally;

a plurality of parallel holes spaced equidistant from said slot for receiving said pegs;

said securing bolt and securing nut threadably engage one another to lock said heel plate and said rear portion of said base plate adjacent to one another.

4. A foot operated bass drum assembly as described in claim 3, further comprising a biasing means connected to said rotating shaft for resisting rotation of said rotating shaft.

5. A foot operated bass drum assembly as described in claim 4, wherein the biasing means includes;

a return lever mounted to an extension of said rotating shaft;

a link member pivotally connected to said return lever;

a bracket extending outwardly from a lower portion of one of said upstanding support members having an aperture;

an adjustment bolt extending through said aperture of said bracket;

a cinch nut threadably engaging said adjustment bolt;

an adjustment nut threadably engaging said adjustment bolt such that said bracket is positioned between said cinch nut and said adjustment nut;

a coil spring mounted between said link member and said adjustment bolt.

6. A foot operated bass drum assembly as described in claim 5, further comprising a clamping means for securing said foot pedal assembly to a drum wherein said clamping means includes:

a cross member mounted atop said base plate disposed between lower portions of said upstanding members;

a clamp member mounted atop said base plate forward and adjacent to said cross member centrally deposed between said upstanding support members;

a pair of clamp hinge supports, spaced apart, mounted atop of said clamp member adjacent to said cross member each further comprising an aperture;

a pivot arm deposed between said clamp hinge supports having a forward portion and a rear portion, said pivot arm having integrally formed pintle members engaging each of said apertures;

a clamp base mounted atop of said base plate rearward of said support members;

a clamp screw threadably engaging said clamp base to engage said pivot arm.

7. A foot operated bass drum assembly as described in claim 3 further comprising a clamping means for securing said foot pedal assembly to a drum.

8. A foot operated bass drum assembly as described in claim 7, wherein the clamping means includes;

a cross member mounted atop said base plate disposed between lower portions of said upstanding members;

a clamp member mounted atop said base plate forward and adjacent to said cross member centrally deposed between said upstanding support members;

a pair of clamp hinge supports, spaced apart, mounted atop of said clamp member adjacent to said cross member each further comprising an aperture;

a pivot arm deposed between said clamp hinge supports having a forward portion and a rear portion, said pivot arm having integrally formed pintle members engaging each of said apertures;

a clamp base mounted atop of said base plate rearward of said support members;

a clamp screw threadably engaging said clamp base to engage said pivot arm.

9. A foot operated bass drum assembly as described in claim 2, further comprising a biasing means connected to said rotating shaft for resisting rotation of said rotating shaft.

10. A foot operated bass drum assembly as described in claim 9, wherein the biasing means includes;

a return lever mounted to an extension of said rotating shaft;

a link member pivotally connected to said return lever;

a bracket extending outwardly from a lower portion of one of said upstanding support members having an aperture;

an adjustment bolt extending through said aperture of said bracket;

a cinch nut threadably engaging said adjustment bolt;

an adjustment nut threadably engaging said adjustment bolt such that said bracket is positioned between said cinch nut and said adjustment nut;

a coil spring mounted between said link member and said adjustment bolt.

11. A foot operated bass drum assembly as described in claim 2 further comprising a clamping means for securing said foot pedal assembly to a drum.

12. A foot operated bass drum assembly as described in claim 11, wherein the clamping means includes;

a cross member mounted atop said base plate disposed between lower portions of said upstanding members;

a clamp member mounted atop said base plate forward and adjacent to said cross member centrally deposed between said upstanding support members;

a pair of clamp hinge supports, spaced apart, mounted atop of said clamp member adjacent to said cross member each further comprising an aperture;

a pivot arm deposed between said clamp hinge supports having a forward portion and a rear portion, said pivot arm having integrally formed pintle members engaging each of said apertures;

a clamp base mounted atop of said base plate rearward of said support members;

a clamp screw threadably engaging said clamp base to engage said pivot arm.

13. A foot operated bass drum assembly as described in claim 12, further comprising a biasing means connected to said rotating shaft for resisting rotation of said rotating shaft.

14. A foot operated bass drum assembly as described in claim 13, wherein the biasing means includes;

a return lever mounted to an extension of said rotating shaft;

a link member pivotally connected to said return lever;

a bracket extending outwardly from a lower portion of one of said upstanding support members having an aperture;

an adjustment bolt extending through said aperture of said bracket;

a cinch nut threadably engaging said adjustment bolt; an adjustment nut threadably engaging said adjustment bolt such that said bracket is positioned between said cinch nut and said adjustment nut;

a coil spring mounted between said link member and said adjustment bolt.

15. A foot operated bass drum assembly as described in claim 2, further comprising;

a front and rear friction pad mounted underneath said base plate, said front friction pad mounted at or near said front end of said baseplate, said rear friction pad mounted at or near said rear portion of said base plate;

said rear friction pad having a slot, wider than said slot of said rear portion of said base plate, to receive said securing bolt.

16. A foot operated drum pedal assembly as described in claim 2, wherein;

said heel plate includes:

a bore extending therethrough generally located at it's center for receiving a securing bolt;

a pair of downwardly extending pegs equidistant from said bore;

said rear end of said base plate having:

a slot for receiving a securing nut allowing said securing nut to slide horizontally;

a plurality of parallel holes spaced equidistant from said slot for receiving said pegs;

said securing bolt and securing nut threadably engage one another to lock said heel plate and said rear portion of said base plate adjacent to one another.

17. A foot operated drum pedal assembly for selectively striking a face member of a drum to produce sound, said pedal assembly comprising;

a pivoting striking means for striking said face member;

a heel plate;

an elongated base plate extending along a horizontal direction from a rear end to a front end, said heel plate being supported on said rear end, and said striking means being supported on said front end;

a foot pedal pivotally secured to said heel plate, said foot pedal actuating said striking means; and a securing means to positively and adjustably secure said heal plate relative to said rear end of said base plate.

18. A foot operated drum pedal assembly as described in claim wherein said heel plate includes:

a bore extending therethrough in a direction perpendicular to said horizontal direction for receiving a securing bolt.

19. A foot operated drum pedal assembly as described in claim wherein said heel plate includes:

a pair of downwardly extending pegs to engage a pair of corresponding holes in said rear end of said base plate.

20. A foot operated drum pedal assembly as described in claim wherein said rear end of said base plate includes:

a slot for receiving a securing nut allowing said securing nut to slide horizontally;

a plurality of parallel holes spaced apart for receiving a pair of corresponding pegs.

* * * * *